US012624709B2

(12) United States Patent
Kus et al.

(10) Patent No.: US 12,624,709 B2
(45) Date of Patent: May 12, 2026

(54) ROTARY PRESSURE EXCHANGER

(71) Applicant: Sulzer Management AG, Winterthur (CH)

(72) Inventors: Bartosz Kus, Winterthur (CH); Karel De Raeve, Winterthur (CH)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 18/198,096

(22) Filed: May 16, 2023

(65) Prior Publication Data

US 2023/0375009 A1 Nov. 23, 2023

(30) Foreign Application Priority Data

May 20, 2022 (EP) ..... 22174648

(51) Int. Cl.
*F04F 13/00* (2009.01)

(52) U.S. Cl.
CPC ..... *F04F 13/00* (2013.01)

(58) Field of Classification Search
CPC ..... F04F 13/00; F01B 3/0032; F01B 3/0052; F03C 1/0636; F03C 1/0644; F05C 2201/0448; F05C 2203/08
See application file for complete search history.

(56) References Cited

U.S. PATENT DOCUMENTS

2006/0037907 A1* 2/2006 Shumway ..... F04F 13/00 418/5
2012/0257991 A1* 10/2012 Woodthorpe ..... F04F 13/00 417/92
2021/0246910 A1* 8/2021 Hauge ..... F04F 13/00

FOREIGN PATENT DOCUMENTS

CN 102865259 A 1/2013
CN 206159137 U 5/2017

OTHER PUBLICATIONS

European Search Report issued Oct. 27, 2022 in corresponding European Application No. 22174648.0.

* cited by examiner

*Primary Examiner* — Kenneth J Hansen
(74) *Attorney, Agent, or Firm* — Spencer Fane, LLP

(57) ABSTRACT

A rotary pressure exchanger includes a housing and a rotor. Channels are inside the rotor to transfer pressure from a first fluid to a second fluid. Each channel extends parallel to the axis of rotation, and the housing includes a first inlet port for supplying the first fluid to the channels, a first outlet port for discharging the first fluid from the channels, a second inlet port for suppling the second fluid to the channels, and a second outlet port for discharging the second fluid from the channels. The first and second inlet ports are radial inlet ports, such that the first fluid and the second fluid enter the rotor in a radial direction perpendicular to the axial direction, and the first outlet port and the second outlet port are radial outlet ports, such that the first fluid and the second fluid leave the rotor in the radial direction.

18 Claims, 6 Drawing Sheets

ROTARY PRESSURE EXCHANGER

CROSS-REFERENCE TO RELATED APPLICATION

This application claims priority to European Patent Application 22174648.0, filed May 20, 2022, the contents of which are hereby incorporated by reference in its entirety.

BACKGROUND

Technical Filed

The disclosure relates to a rotary pressure exchanger for transferring pressure from a first fluid to a second fluid in accordance with the preamble of the independent claim. Rotary pressure exchangers are used to transfer energy in the form of pressure from a first fluid available at a high pressure to a second fluid available at a low pressure. Usually, the energy transfer takes place by a positive displacement of the fluids following Pascal's principle. Such rotary pressure exchangers are configured with a rotor which is driven by the fluids or by an external motor. A well-known application of rotary pressure exchangers is the field of reverse osmosis systems, for example Sea Water Reverse Osmosis (SWRO) for desalination of seawater or brackish water. Here, the rotary pressure exchanger is used as an efficient energy recovery device.

BACKGROUND INFORMATION

In some reverse osmosis systems a semipermeable membrane can be passed by the water or a solvent but not by solutes like dissolved solids, molecules or ions. For reverse osmosis the membrane is supplied with a pressurized feed fluid for example seawater. Only the solvent, for example the water, can pass the membrane and will leave the membrane unit as permeate fluid, for example fresh water. The remaining part of the feed fluid that does not pass through the membrane is discharged from the membrane unit as concentrate fluid, for example brine. The feed fluid has to be supplied to the membrane with a high pressure to overcome the osmotic pressure.

Thus, reverse osmosis typically is a process where a pressurized feed fluid is required and the concentrate fluid leaving the membrane unit still has a considerably large residual pressure that enables to recover a part of the pressurizing energy as mechanical energy. In seawater desalination, for example, the required pressure of the feed fluid (seawater) may be from 45 bar to 75 bar depending among others on the salinity and the temperature of the seawater. The pressure in the fresh water (permeate fluid) can be between zero and three bars, the pressure in the brine (concentrate fluid) is typically between 2 and 5 bars less than the feed pressure, i.e. 40-73 bar.

Rotary pressure exchangers are used to transfer pressure from the brine, Which is still at a considerably high pressure, to the feed fluid, thus recovering energy from the brine.

The rotor of a rotary pressure exchanger is typically designed to include straight axially oriented ducts or channels, in which the pressure transfer takes place by positive displacement of the fluids. It is known to arrange the rotor between two stationary end covers which are used to supply the fluids to the rotor and to discharge the fluids from the rotor. For positioning and supporting the rotor it is known to use an axle which is arranged at the center of the rotor as it is disclosed for example in U.S. Pat. No. 10,125,796.

Another conventional solution is a sleeve positioning concept, where the rotor is surrounded by a stationary sleeve. During operation of the device the narrow gap between the rotor and the sleeve provides a hydrodynamic support of the rotor.

SUMMARY

In conventional rotary pressure exchangers, the fluids are supplied and discharged through the end covers and in axial direction into and from the rotor. Each end cover includes high and low pressure ports for the fluids. In each end cover the high and the low pressure port are separated by a sealing space formed between the stationary face between the ports and the end faces of the rotor. In order to limit the leakage between the ports extremely small clearances between the end covers and the rotor are required. It has been determined that in this makes the manufacturing process complex and expensive and might require special materials. Due to the short distance between the high pressure port and the low pressure port the resulting leakage limits the efficiency of the device, despite using extremely narrow clearances (typically in the range of several micrometers).

Based on these deficiencies in the conventional systems, it is therefore an object of the disclosure to propose a rotary pressure exchanger with an improved efficiency.

The subject matter of embodiments of the invention satisfying this object is characterized by the features disclosed herein.

Thus, according to the disclosure, a rotary pressure exchanger is proposed for transferring pressure from a first fluid to a second fluid, comprising a housing and a rotor mounted within the housing for rotation about an axis of rotation defining an axial direction, wherein a plurality of channels is disposed inside the rotor for transferring pressure from the first fluid to the second fluid, wherein each channel extends parallel to the axis of rotation, wherein the housing comprises a first inlet port for supplying the first fluid to the channels in the rotor, a first outlet port for discharging the first fluid from the channels in the rotor, a second inlet port for suppling the second fluid to the channels in the rotor, and a second outlet port for discharging the second fluid from the channels in the rotor. The first inlet port and the second inlet port are configured as radial inlet ports, such that the first fluid and the second fluid enter the rotor in a radial direction perpendicular to the axial direction, and the first outlet port and the second outlet port are configured as radial outlet ports, such that the first fluid and the second fluid leave the rotor in the radial direction.

By configuring the inlet ports and the outlet ports as radial ports, both fluids enter the rotor and leave the rotor in the radial direction. By this measure the distance between the first inlet port and the first outlet port as well as the distance between the second inlet port and the second outlet port can be increased. This results in a considerable reduction of the leakage flow from the first inlet port to the first outlet port and in a considerable reduction of the leakage flow between the second outlet port and the second inlet port. The reduction of the leakage flow increases the efficiency of the rotary pressure exchanger.

In addition, the configuration of the inlet ports and the outlet ports as radial ports makes it possible to reduce the overall length of the rotary pressure exchanger regarding the axial direction, because there is no longer the need to supply and to discharge the fluids in the axial direction to and from the rotor.

Furthermore, the configuration of the inlet ports as radial ports has the advantage that the torque for driving the rotation of the rotor by the fluids is easier to control and to adjust. The configuration of the inlet ports renders possible a better design control of the driving momentum created by imparting a circumferential velocity component to the incoming fluid supplied to the rotor. In addition, due to reduced geometrical constraints regarding the inlet ports, higher values of the driving torque can be realized. A strong driving torque can be advantageously used, for example, to drive a roller bearing based system for the rotor, or overcoming resistance of additional seals that could be used to further limit the leakage between the different ports.

Preferably, the first inlet port and the first outlet port are arranged at the same axial position and opposite each other with respect to the circumferential direction. In addition, the second inlet port and the second outlet port are arranged at the same axial position and opposite each other with respect to the circumferential direction. The axial position of the first inlet port/outlet port is spaced apart from the axial position of the second inlet port/outlet port. By arranging the first inlet port opposite the first outlet port, the distance between the two ports measured in the circumferential direction can be maximized. By arranging the second inlet port opposite the second outlet port, the distance between the two ports measured in the circumferential direction can be maximized. These measures are advantageous to decrease the leakage between the first ports as well as the leakage between the second ports.

Furthermore, the respective extension of each of the first and the second ports in the circumferential direction can be increased as compared to an axial arrangement of the ports. By increasing the extension of the ports in the circumferential direction, the flow rate through the rotary pressure exchanger can be increased, which is an advantage regarding the overall performance of the rotary pressure exchanger. The other way around, for a given flow rate the rotary pressure exchanger can be configured smaller and/or manufactured cheaper as compared to rotary pressure exchangers known in the art.

According to a preferred embodiment the rotor extends from a first rotor end in the axial direction to a second rotor end, wherein the rotor comprises a circumferential surface delimiting the rotor with respect to the radial direction, wherein each channel comprises a first opening and a second opening for the fluids, and wherein each first opening and each second opening are arranged in the circumferential surface of the rotor. Preferably, each first opening is aligned with the first inlet port and the first outlet port regarding the axial direction, and each second opening is aligned with the second inlet port and the second outlet port regarding the axial direction. Arranging each first opening and each second opening in the circumferential surface of the rotor has the advantage, that each channel can be configured with closed axial ends at both axial ends of the channel. Thus, a free-floating or a freely sliding piston-like or ball-like separator can be disposed in each of the channels for at least reducing the mixing of the first and the second fluid in the channels.

Furthermore, it is a preferred configuration that the rotary pressure exchanger comprises a plurality of bearing flow passages for providing a hydrostatic support of the rotor.

In a preferred embodiment the rotary pressure exchanger comprises a first end cover and a second end cover, with each end cover arranged stationary with respect to the housing, wherein the rotor is arranged between the first end cover and the second end cover regarding the axial direction. The axial faces at the first rotor end and at the second rotor end are arranged very close to the mating partner faces of the end covers with only a narrow clearance therebetween. The narrow clearance reduces the leakage and is advantageous in view of a hydrostatic support of the rotor.

Due to the configuration of the inlet ports and the outlet ports as radial ports, both the first end cover and the second end cover can have a very simple configuration, e.g. a very simple geometry, because there is no need to discharge the fluids or to supply the fluids through the end covers. Thus, there is no need to provide any ports for the fluids in the end covers. This is a considerable advantage regarding the manufacturing of the end covers, because the manufacturing becomes cheaper and less time consuming. Especially if the end covers are made of a material that is laborious or difficult to machine, e.g. a ceramic material, a simple geometry or a simple configuration of the end covers is a considerable advantage.

Preferably, each end cover is made of a ceramic material, because this allows for a very narrow clearance between the rotating components and the stationary mating components. Ceramic components are also very suitable for creating well-functioning hydrostatic bearings. Of course, it is also possible to choose other materials, i.e. non-ceramic materials for these components.

In a particularly preferred embodiment each rotor end comprises a bearing pin extending in the axial direction and configured coaxially with the axis of rotation, wherein each end cover comprises a bearing recess configured for receiving one of the bearing pins, and wherein each bearing pin engages with one of the bearing recesses. The bearing pins, having a considerably smaller diameter than the circumferential surface of the rotor constitute an extension of the rotating axle, the centerline of which constitutes the axis of rotation, about which the rotor rotates during operation. Both bearing pins are preferably identically configured. Each bearing pin engages with one of the bearing recesses in the end covers of the rotor, so that the rotor is journaled by the bearing pins arranged in the bearing recesses. The clearance between each bearing pin and the respective bearing recess is dimensioned very small, e.g. a few micrometers, to reduce the leakage providing lubrication for the hydrostatic bearings realized between the bearing pins and the bearing recesses.

Regarding the configuration with the bearing pins it is preferred, that at each rotor end a radial bearing flow passage and an axial bearing flow passage are disposed between the bearing recess and the bearing pin engaging the bearing recess, wherein each radial bearing flow passage is configured to provide hydrostatic radial support of the rotor, and wherein each axial bearing flow passage is configured to provide hydrostatic axial support of the rotor.

Thus, with the bearing recesses and the bearing pins engaging, the rotor can be hydrostatically supported, wherein the radial flow passages extending about the outer circumferential surfaces of the bearing pins provide the radial bearings and the axial bearing flow passages arranged between the bearing pins and the respective bearing recess with respect to the axial direction provide the axial bearings for the rotor.

In addition, in the configuration with the bearing pins there is no need for an outer stationary sleeve surrounding the rotor for providing support to the rotor and for positioning the rotor. Therefore, the outer diameter of the rotor can be increased without increasing the inner diameter of the housing. Therewith, the maximum flow rate of the rotary pressure exchanger is increased.

Thus, compared to the sleeve-based positioning of the rotor, i.e. the rotor being surrounded by an external stationary sleeve, the configuration with the bearing pins makes it possible to increase the maximum flow rate per size of the rotary pressure exchanger.

In particular the combination of the bearing pins with the end covers having no ports, enables an improved pressure balancing of the end covers additionally aided by having a more rigid structure of the end covers.

According to a preferred configuration, the rotor comprises an axle and a rotor body, wherein the axle comprises both bearing pins and extends from the bearing pin at the first rotor end to the bearing pin at the second rotor end, wherein the rotor body comprises all channels, and wherein the rotor body is fixedly connected to the axle in a torque proof manner. Thus, the rotor comprises two main components, namely the axle including the two bearing pins with a middle part connecting the bearing pins, and the rotor body, in which all the channels are arranged. This has the advantage that the axle and the rotor body can be made of different materials, each of which is particularly suited for the function of the respective component of the rotor.

It is preferred that the axle is made of a first material, preferably a ceramic material, wherein the rotor body is made of a second material, preferably a metallic material, and wherein the first material is different from the second material. Thus, the use of materials which are more difficult to machine, such as ceramic materials, is reduced to the component, namely the axle, which requires the highest precision and the narrowest clearance to its mating partners. Other components, such as the rotor body can be made of a material, that is easier to machine, which reduces the costs. The rotor body is preferably made of a metallic material. In particular for SWRO applications a metallic material is preferred, which has a high resistance against corrosion, for example titanium. Thus, the rotor body can be made of titanium, for example, and then be fixed to the ceramic axle by a shrink-fit.

According to a preferred embodiment, the axle is configured as a hollow axle comprising a central opening extending completely through the axle in the axial direction, wherein each end cover comprises a central bore aligned with the central opening, with each central bore extending completely through the end cover in the axial direction, wherein a bolt extends in the axial direction through each central bore and through the central opening, and wherein the bolt is secured to each end cover. This embodiment has a particularly rigid and stable configuration of the rotor and the end covers. The stationary bolt extending through the hollow axle of the rotor and the end covers constitutes a tension rod securing the end covers to each other in a highly reliable manner, even at high pressure of the first or the second fluid. During operation, the hollow axle together with the rotor body rotates about the stationary bolt.

The bolt can be made of a single material, for example a metallic material. As an alternative, the bolt can comprise a central core extending in the axial direction along the entire length of the bolt, and an sleeve arranged coaxially with the core and abutting against the core, wherein the sleeve is made of a first material, preferably a ceramic material, wherein the central core is made of a second material, preferably a metallic material, and wherein the first material is different from the second material. Thus, the bolt can comprise two different materials and include, for example, a ceramic core and a metallic sleeve enclosing the ceramic core.

According to another preferred embodiment the rotary pressure exchanger comprises a rotor sleeve extending regarding the axial direction from the first end cover to the second end cover, with the rotor sleeve arranged stationary with respect to the housing, wherein the rotor is arranged within the rotor sleeve, so that the rotor sleeve surrounds the circumferential surface of the rotor. Regarding the rotor sleeve, this embodiment corresponds essentially to the sleeve-based positioning of the rotor, in which the clearance between the rotor sleeve and the circumferential surface of the rotor is used for a hydrostatic and/or hydrodynamic support of the rotor. This embodiment does not require the bearing pins at the rotor and the bearing recesses in the end covers making the end covers very simple components.

Regarding the configuration of the channels it is preferred that each channel extends from a first axial end to a second axial end, wherein at least one of the first axial end and the second axial end of each channel includes a closing element. Thus, each channel can be machined as a blind bore in the rotor, and afterwards the blind bore is closed at its open end by the closing element. The first and the second opening of the channel can be machined by bores extending in the radial direction from the circumferential surface of the rotor into the channel.

As a further option, each first axial end includes a first plug for closing the first axial end, and wherein each second axial end includes a second plug for closing the second axial end. Thus, each channel can be machined as an end-to-end bore extending in axial direction throughout the rotor. Afterwards, each axial end of the channel is closed with a plug and the first and the second opening of the channel can be machined by bores extending in the radial direction from the circumferential surface of the rotor into the channel.

Furthermore, it is possible to provide in each channel a freely sliding separator for reducing a mixing of the first fluid and the second fluid. The freely sliding or free-floating separator works as a piston and transfers the pressure between the first and the second fluid.

Further advantageous measures and embodiments of the invention will become apparent from the dependent claims.

BRIEF DESCRIPTION OF THE DRAWINGS

Embodiments of the invention will be explained in more detail hereinafter with reference to the drawings.

DETAILED DESCRIPTION

Figure 1:
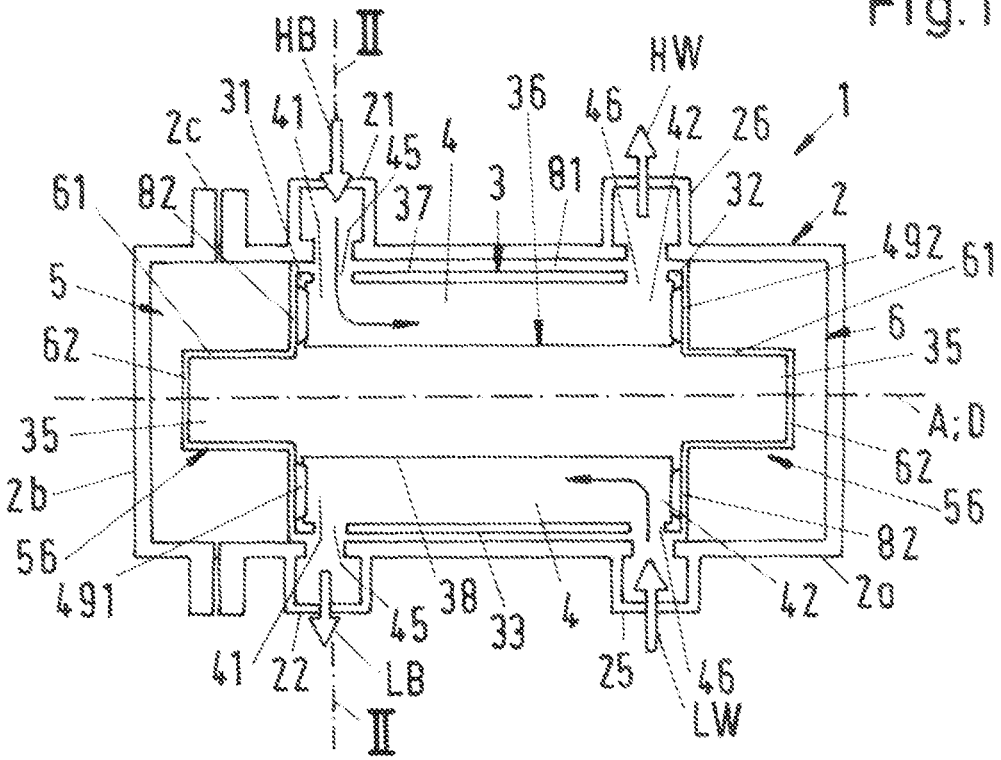
FIG. 1 illustrates a schematic cross-sectional view of a first embodiment of a rotary pressure exchanger according to the disclosure in a cut along the axial direction.

FIG. 1 shows a schematic cross-sectional view of a first embodiment of a rotary pressure exchanger according to the disclosure, which is designated in its entity with reference numeral 1. The rotary pressure exchanger 1 transfers energy in the form of pressure from a first fluid to a second fluid. The rotary pressure exchanger 1 comprises a housing 2 and a rotor 3, which is arranged in the housing 2 and mounted for rotating about an axis of rotation D defining an axial direction A. The rotor 3 extends from a first rotor end 31 in the axial direction A to a second rotor end 32 and comprises a circumferential surface 33 delimiting the rotor 3 with respect to the radial direction which is perpendicular to the axial direction A. The rotor ends 31, 32 and the circumferential surface 33 form an essentially cylindrical shape, with the axis of rotation D coinciding With the cylinder axis. The diameter of the circumferential surface 33 is slightly smaller than the inner diameter of the housing 2, such that there is a narrow rotor clearance 81 between the circumferential surface 33 of the rotor 3 and the inner wall of the housing 2 surrounding the circumferential surface 33. The rotor clearance 81 is adjusted on the one hand to allow a free, i.e. contactless, rotation of the rotor 3 in the housing 2, and on the other hand to allow only a very small leakage flow along the circumferential surface 33. In particular, the rotor clearance 81 restricts the leakage flow in the axial direction A, i.e. the leakage flow between the first rotor end 31 and the second rotor end 32.

Figure 2:
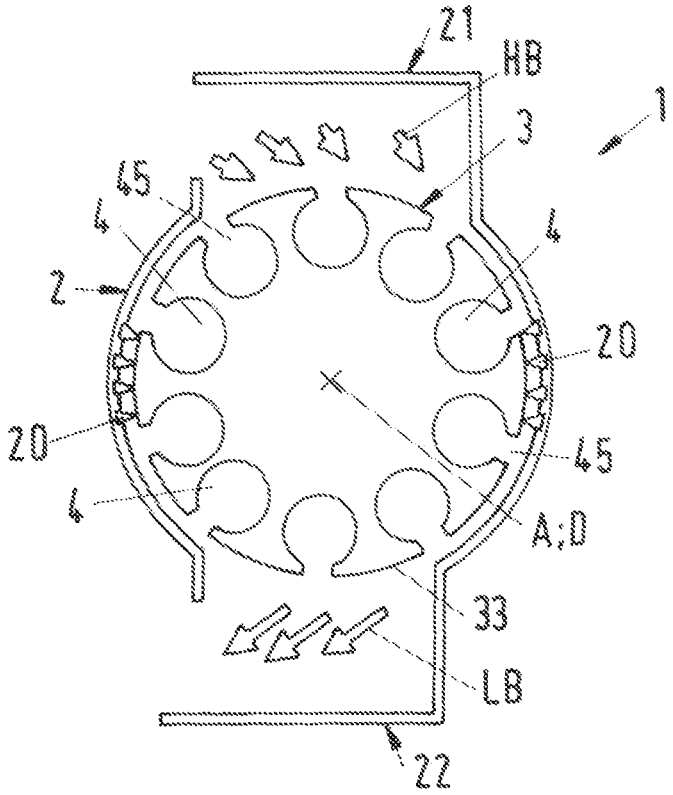
FIG. 2 illustrates a schematic cross-sectional view of the first embodiment in a cut perpendicular to the axial direction along the cutting line II-II in FIG. 1.

For a better understanding FIG. 2 shows the first embodiment of the rotary pressure exchanger 1 again, however in a cross-sectional view in a cut perpendicular to the axial direction A, i.e. in radial direction, and along the cutting line II-II in FIG. 1. A plurality of channels 4 is disposed inside the rotor 3 for transferring pressure from the first fluid to the second fluid. Each channel 4 extends parallel to the axis of rotation D and has a first axial end 41 located at the first rotor end 31, as well as a second axial end 42 located at the second rotor end 32. Both the first axial end 41 and the second axial end 42 of each channel 4 are closed with respect to the axial direction A, for example by a first plug 491 arranged at the first axial end 41 for closing the first axial end 41 and a second plug 492 arranged at the second axial end 42 for closing the second axial end 42.

Thus, each channel 4 can be manufactured by machining a longitudinal bore into the rotor 3, wherein the longitudinal bore extends completely throughout the rotor 3 in the axial direction A. After that, the two axial ends of the longitudinal bore are closed with the first plug 491 and the second plug 492, respectively. Furthermore, each channel 4 has a first opening 45 and a second opening 46 for supplying and discharging the fluids to and from the channel 4. Each first opening 45 and each second opening 46 are arranged in the circumferential surface 33 of the rotor 3, so that the fluids enter and leave each channel 4 in the radial direction. For each channel 4 the first opening 45 is arranged next to the first axial end 41 of the channel 4, and the second opening 46 is arranged next to the second axial end 42 of the channel 4. The first opening 45 and the second opening 46 can be manufactured by drilling or otherwise providing a lateral bore extending from the circumferential surface 33 of the rotor 3 in the radial direction to the longitudinal bore.

As can be best seen in FIG. 2 the plurality of channels 4, for example up to sixteen channels 4, is preferably arranged on a circle having its center on the axis of rotation D. The channels 4 are arranged inside the rotor 3 and close to the circumferential surface 33 of the rotor 3. Each channel 4 is fluidly connected to the circumferential surface 33 both by its first opening 45 and by its second opening 46. All channels 4 are parallel to each other and preferably equidistantly distributed regarding the circumferential direction of the rotor 3, i.e. the distance between two adjacent channels 4 as measured in the circumferential direction of the rotor 3 is preferably equal for each pair of adjacent channels 4.

The housing 2 comprises four ports for supplying and discharging the fluids to and from the rotor 3, namely a first inlet port 21 fix supplying the first fluid to the channels 4 of the rotor 3, a first outlet port 22 for discharging the first fluid from the channels 4 of the rotor 3, a second inlet port 25 for supplying the second fluid to the channels 4 of the rotor 3, and a second outlet port 26 for discharging the second fluid from the channels 4 of the rotor 3. Each of the first inlet port 21, the second inlet port 25, the first outlet port 22 and the second outlet port 26 is configured as a radial port, so that the first fluid and the second fluid enter and leave the rotor 3 in the radial direction as it is indicated by the arrows HB, LB, LW and HW in FIG. 1.

Without loss of generality is the first fluid the fluid which is available at a high pressure and the second fluid is the fluid having a low pressure. The second fluid is the fluid to which the pressure shall be transferred from the first fluid. The arrow FIB indicates the first fluid entering the rotor 3 with a high pressure, and the arrow LB indicates the first fluid leaving the rotor 3 with a low pressure. The arrow LW indicates the second fluid entering the rotor 3 with a low pressure, and the arrow HW indicates the second fluid leaving the rotor 3 with a high pressure. The terms "high pressure" and "low pressure" have to be understood only in a comparative sense, namely that for each fluid "high pressure" designates a pressure that is higher than "low pressure" for the same fluid. The term "low pressure" used with respect to the first fluid does not have to refer to the same absolute value of the pressure than the term "low pressure" when used with respect to the second fluid. Analogously, the term "high pressure" used with respect to the first fluid does not have to refer to the same absolute value of the pressure than the term "high pressure" when used with respect to the second fluid.

The first inlet port 21 and the first outlet port 22 are arranged at the housing 2 close to the position of the first rotor end 31. The second inlet port 25 and the second outlet port 26 are arranged at the housing 2 close to the position of the second rotor end 32. Preferably, the first inlet port 21 and the first outlet port 22 are arranged at the same axial position, i.e. at the same position regarding the axial direction A, and opposite each other with respect to the circumferential direction. Analogously, the second inlet port 25 and the second outlet port 26 are arranged at the same axial position and opposite each other with respect to the circumferential direction. The axial position of the first inlet port 21/outlet port 22 is spaced apart from the axial position of the second inlet port 25/outlet port 26. By arranging the first inlet port 21 opposite the first outlet port 22, the distance between the two ports 21, 22 measured in the circumferential direction of the rotor 3 can be maximized. By arranging the second inlet port 25 opposite the second outlet port 26 the distance between the two ports 25, 26 measured in the circumferential direction can be maximized. These measures are advantageous to decrease the leakage between the first ports 21, 22 as well as the leakage between the second ports 25, 26.

To further reduce the leakage between the first inlet port 21 and the first outlet port 22 as well as the leakage between the second inlet port 25 and the second outlet port 26, it is possible to optionally provide leakage preventing features 20 (see FIG. 2) at the inner wall of the housing 2 and at the same position with respect to the axial direction A, where the first port 21, 22 or the second ports 25, 26, respectively, are located. Thus, the leakage preventing features 20 are optionally arranged in the leakage path extending between the first inlet port 21 and the first outlet port 22 along the outer circumference of the rotor 3, and/or the leakage preventing features 20 are optionally arranged in the leakage path extending between the second inlet port 25 and the second outlet port 26 along the outer circumference of the rotor 3. The leakage preventing features 20 can be configured for example as ribs or as grooves. The leakage preventing features 20 can e.g. form a labyrinth or any kind of a throttle. Furthermore the leakage preventing features 20 can be advantageous to prevent cavitation.

The respective extension of each of the first ports 21, 22 and the second ports 25, 26 as measured in the circumferential direction can be increased as compared to an axial arrangement of the ports. By increasing the extension of the ports 21, 22, 25, 26 in the circumferential direction, the flow rate through the rotary pressure exchanger 1 can be increased, which is an advantage regarding the overall performance and economics of the rotary pressure exchanger 1.

During operation of the rotary pressure exchanger 1, the rotation of the rotor 3 is driven by the fluids, both by the first and the second fluid entering the rotor 3 as it is indicated by the arrows HB and LW. The rotary pressure exchanger 1 does not require an external motor. Also in view of the torque driving the rotation of the rotor 3 the configuration of the port 21, 22, 25, 26 as radial ports is advantageous. Because the fluids and in particular the first fluid enter the rotor 3 in the radial direction a large torque can be generated for driving the rotation of the rotor. A large torque for driving the rotor 3 has the advantage, that additional seals can be disposed in particular between the rotor 3 and the stationary parts of the rotary pressure exchanger 1, which increases the efficiency. Furthermore, because a large torque is available it is also possible to provide contact bearings such as roller bearings for the support of the rotor 3 as an alternative or as a supplement to the hydrostatic support of the rotor 3, which will described later on.

The principle mode of operation of the rotary pressure exchanger 1 is the same as it is known from conventional rotary pressure exchangers and will therefore only be summarized. When the first opening 45 of a channel 4 passes the first inlet port 21 during rotation of the rotor 3, the high pressure first fluid enters the channel 4 as indicated by arrow HB, pressurizes the low pressure second fluid in the channel 4, and pushes the pressurized second fluid out of the channel 4 through the second opening 46 of the channel 4 and the second outlet port 26 as indicated by the arrow HW in FIG. 1. Thus, the second fluid is discharged through the second outlet port 26 as high pressure second fluid, During the positive displacement of the second fluid in the channel 4 by a direct contact of the fluids, pressure—and therewith energy—is transferred from the first fluid to the second fluid, i.e. the second fluid is pressurized by the first fluid and discharged from the channel 4 until the channel 4 is essentially completely filled with the first fluid. Upon further rotation the first opening 45 passes the first outlet port 22. Since the first fluid is now at a low pressure (due to the pressure transfer to the second fluid and subsequent contact with the low pressure second fluid inlet), the low pressure second fluid available at the second inlet port 25 enters the channel 4 as indicated by the arrow LW in FIG. 1 and pushes the low pressure first fluid out of the channel 4 as indicated by the arrow LB in FIG. 1. After that, the channel 4 is essentially completely filled with the low pressure second fluid. Upon further rotation of the rotor 3, the first opening 45 of a channel 4 again passes the first inlet port 21 and the cycle starts anew.

By way of example, in the following description reference is made to an important application, namely that the rotary pressure exchanger 1 is used as an energy recovery device in a reverse osmosis system, in particular in a SWRO system.

In a SWRO system reverse osmosis is used for the desalination of seawater. The reverse osmosis system comprises a membrane unit having a membrane for performing the reverse osmosis process. The membrane unit has an inlet for receiving a feed fluid, here seawater, a permeate outlet for discharging a permeate fluid, here fresh water, and a concentrate outlet for discharging a concentrate fluid which is called brine in SWRO applications. The membrane unit is supplied with the feed fluid seawater comprising water as a solvent and solutes like dissolved solids, molecules or ions, Essentially only the water can pass the membrane and will leave the membrane unit as the permeate fluid, namely fresh water. The seawater has to be supplied to the membrane with a high pressure being high enough to overcome the osmotic pressure. Therefore, the brine leaving the membrane unit is typically still under quite a high residual pressure which can be up to 95% (or even more) of the feed pressure, i.e. the high pressure under which the seawater is supplied to the membrane unit. This residual pressure of the brine makes it possible to recover part of the pressurizing energy by an energy recovery device, such as the rotary pressure exchanger 1 according to the disclosure.

Thus, in the following description of the preferred embodiments of the disclosure reference is made to the important practical application that the rotary pressure exchanger 1 is used as an energy recovery device in a SWRO system. In such an application the first fluid is the brine, i.e. the concentrate fluid discharged from the membrane unit, and the second fluid is the seawater that has to be pressurized prior to supplying it to the membrane unit.

The brine discharged from the membrane unit is supplied to the first inlet port 21 of the rotary pressure exchanger 1 as indicated by the arrow HB in FIG. 1. The pressure of the brine discharged from the membrane unit is usually only a few percentage, for example at most 5%, lower than the feed pressure, with which the seawater is supplied to the membrane unit. The pressure of the brine at the first inlet port 21 is for example between 55 bar and 60 bar (5.5 MPa-6.0 MPa). The seawater is supplied to the second inlet port 25, for example by a seawater supply pump, as it is indicated by the arrow LW in FIG. 1. Usually, the seawater is supplied to the second inlet port 25 with a small overpressure, e.g. between one and two bar (0.1 to 0.2 MPa) overpressure.

In the rotor 3 of the rotary pressure exchanger 1 the pressure is transferred by positive displacement from the brine to the seawater. The seawater is discharged at the second outlet port 26 as indicated by the arrow HW with a pressure, which is only slightly smaller, for example about 2% smaller, than the pressure of the brine at the first inlet port 21. The discharged high pressure seawater is then for example merged into a pressurized seawater flow generated by a high pressure pump. The pressurized seawater flow is supplied to the inlet of the membrane unit. The depressurized brine having usually an overpressure of less than one bar is discharged from the channels 4 of the rotor through the first outlet port 22 by the seawater entering the channels 4 from the second inlet port 25. The discharge of the low pressure brine is indicated by arrow LB.

As it can be best seen in FIG. 1, in the first embodiment of the rotary pressure exchanger 1, the rotor 3 is arranged regarding the axial direction A between a first end cover 5 and a second end cover 6. Both end covers 5, 6 are arranged inside the housing 2 and arranged stationary with respect to the housing 2. Each end cover 5, 6 has a generally cylindrical shape. Preferably, the outer diameter of the end covers 5, 6 is essentially the same as the inner diameter of the housing 2. Thus, the outer diameter of the end covers 5, 6 differs from the diameter of the circumferential surface 33 of the rotor only by the radial extension of the rotor clearance 81.

Regarding the axial direction A the first end cover 5 and the second end cover 6 are arranged very close to the axial faces of the rotor 3 at the first rotor end 31 and the second rotor end 32, so that there is only a small axial clearance 82 between the first rotor end 31 and the first end cover 5 as well as between the second rotor end 32 and the second end cover 6, The axial clearance 82 is configured to enable free rotation of the rotor 3, i.e. such that the rotor 3 does not contact the first end cover 5 or the second end cover 6. On the other hand, the axial clearance 82 is very narrow to limit the leakage flow along the first rotor end 31 and the second rotor end 32.

The first end cover 5 and the second end cover 6 are supported by the housing 2 to withstand the pressure resulting from the pressurized fluids. In particular, the housing 2 provides support to the end covers 5 and 6 such, that the distance regarding the axial direction A between the first end cover 5 and the second end cover 6 does not change during operation, at least not significantly. The housing 2 can comprise an essentially cylindrical housing body 2*a* having an inner diameter which equals the outer diameter of the end covers 5, 6, and a cover 2*b* for closing the housing body 2*a*. For assembling the rotary pressure exchanger 1, firstly, the second end cover 6 is inserted into the housing body 2*a*. After that, the rotor 3 is inserted into the housing body 2*a*. The first end cover 5 is placed into the cover 2*b* of the housing 2 and the cover 2*b* is firmly secured to the housing body 2*a*, e.g. by a flange connection 2*c*, so that the rotor 3 is arranged between the first end cover 5 and the second end cover 6 regarding the axial direction A. The first end cover 5 and the second end cover 6 are reliably supported, in particular regarding the axial direction A, by the housing 2.

As it can be best seen in FIG. 1, each of the first rotor end 31 and the second rotor end 32 comprises a bearing pin 35 extending in the axial direction A. Each bearing pin 35 has a cylindrical shape and is arranged coaxially with the axis of rotation D. Both bearing pins 35 are configured in an identical manner. The outer diameter of each cylindrical bearing pin 35 is significantly smaller than the outer diameter of the circumferential surface 33 of the rotor 3. The bearing pins 35 constitute an extension of the rotor 3 in the axial direction A.

Each end cover 5, 6 comprises a centrally arranged bearing recess 56, which is configured for receiving one of the bearing pins 35. Each bearing pin 35 engages with one of the bearing recesses 56 for providing support to the rotor 3. The rotor 3 is journaled by the hearing pins 35 engaging with the bearing recesses 56 both with respect to the axial direction A and with respect to the radial direction. The bearing pins 35 and the bearing recesses 56 are configured such that there is only a narrow clearance between the respective bearing recess 56 and the bearing pin 35 engaging therewith, Each clearance forms a plurality of bearing flow passages for providing a hydrostatic support of the rotor 3 during operation. The clearance between the bearing recess 56 and the bearing pin 35 enables a hydrostatic journal or radial bearing for the rotor 3 as well as a hydrostatic axial or thrust bearing for the rotor 3 as will be explained in more detail later on with reference to FIG. 3.

The clearance between each bearing pin 35 and the bearing recess 56 the bearing pin 35 is engaging with, comprises a radial bearing flow passage 61 and an axial bearing flow passage 62. Each radial bearing flow passage 61 is configured as an annular gap surrounding one of the bearing pins 35. Each axial bearing flow passage 62 is configured as a gap arranged between the axial end face of one of the bearing pins 35 and the bottom of the respective bearing recess 56 facing the axial end face of the bearing pin 35. During operation, each radial bearing flow passage 61 provides hydrostatic radial support of the rotor 3 and each axial bearing flow passage 62 provides hydrostatic axial support of the rotor 3. Thus, there is no need for any additional bearings, such as anti-friction bearing, e.g. ball bearings or ceramic roller bearings. Of course, in other embodiments anti-friction bearings or other types of bearings can be provided for the support of the rotor 3, either as a supplement or as an alternative to the hydrostatic bearings.

As it can be best seen in FIG. 1, the rotor 3 is configured except—for the first plugs 491 and second plugs 492 closing the channels 4 with respect to the axial direction A—as a one-piece part, i.e. the bearing pins 35 are integrally formed with the first rotor end 31 and the second rotor end 32, respectively. The rotor 3 can be manufactured by providing a solid blank comprising the cylindrical part delimited by the circumferential surface 33 and the two bearing pins 35 disposed at the first rotor end 31 and the second rotor end 32, respectively. The channels 4 are then manufactured by providing the longitudinal bores and the lateral bores as it has been described hereinbefore. After the channels 4 have been finished the first axial ends 41 of the channels 4 are closed by the first plugs 491 and the second axial ends 42 of the channels 4 are closed by the second plugs 492. Thus, the rotor 3 comprises an axle 36 formed by the two bearing pins 35 and a middle part 38 connecting the two bearing pins, as well as a rotor body 37 surrounding the axle 36, wherein all channels 4 are arranged in the rotor body 37. The rotor body 37 is integrally formed with the axle 36.

Each of the first end cover 5 and the second end cover 6 is configured as a one-piece part. Each end cover 5, 6 can be manufactured by providing a cylindrical blank and machining the bearing recess 56 into the blank, Each end cover 5, 6 has a very simple geometry and, in particular, does not require any ports or additional channels for supplying or discharging the fluids to or from the channels 4 of the rotor 3. Therefore, the manufacturing becomes considerably cheaper and less time consuming as compared to conventional rotary pressure exchanger, in which the fluids are supplied to and discharged from the rotor through the stationary end covers.

Preferably, the one-piece rotor 3, i.e. the axle 36 and the rotor body 37 integrally formed therewith as well as the end covers 5 and 6 are made of a ceramic material, e.g. alumina ceramic. Ceramic materials have the advantage to have a very high dimensional stability and, if at all, only a negligible wear so that the clearances between the rotating parts and their respective stationary mating partners can be configured very narrow. In particular, the radial bearing flow passages 61 and the axial bearing flow passages 62, can be dimensioned very narrow, e.g. having a width of only a few micrometers.

The configuration with the bearing pins 35 engaging with the bearing recesses 56 for providing radial and axial support to the rotor 3 has the advantage, that there is no need for an outer stationary sleeve surrounding the rotor for providing support to the rotor and for positioning the rotor. Therefore, compared to known rotary pressure exchangers having a sleeve-based positioning of the rotor, the outer diameter of the rotor 3 can be increased without increasing the inner diameter of the housing 2. Therewith, the maximum flow rate of the rotary pressure exchanger 1 in relation to the size of the rotor 3 is increased.

Figure 3:
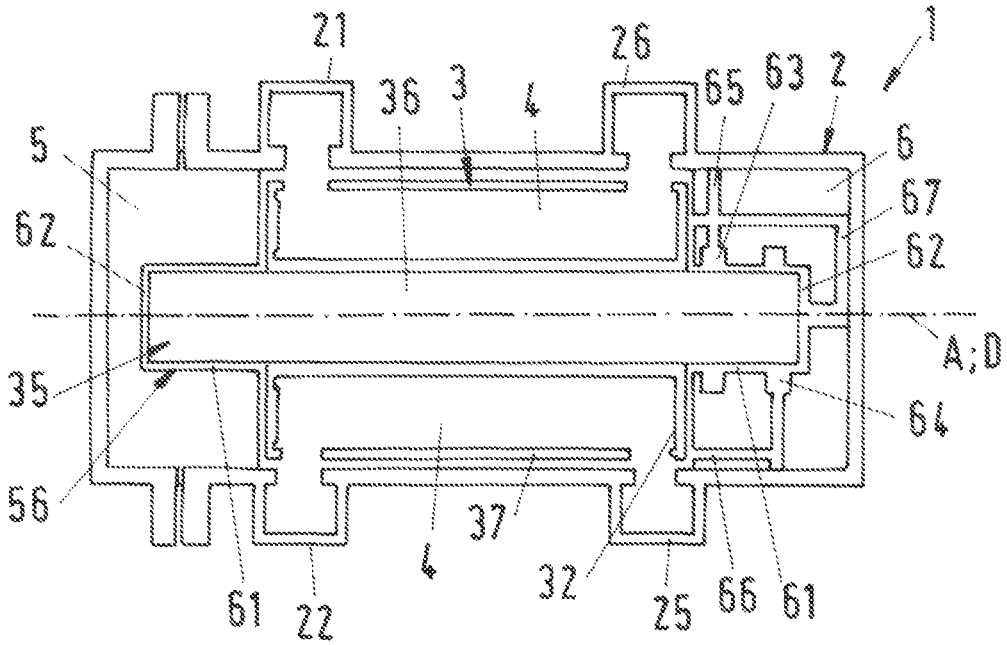
FIG. 3 illustrates a schematic cross-sectional view of a variant of the first embodiment in a cut along the axial direction.

FIG. 3 shows a schematic cross-sectional view of a variant of the first embodiment in a cut along the axial direction A, i.e. in a representation corresponding to FIG. 1. In this variant, the main components of the rotor 3, namely the axle 36 and the rotor body 37 are made of different materials. The axle 36 is made of a first material and the rotor body 37 is made of a second material, wherein the first material is different from the second material. Preferably, the first material is a ceramic material. Furthermore, it is preferred that the second material is a metallic material, for example titanium. In particular for applications in SWRO systems or in other systems, where at least one of the fluids is corrosive, the metallic material is preferably a metal or an alloy having a high corrosion resistance.

The rotor body 37 is fixedly connected to the axle 36 in a torque proof manner. Furthermore, the fixation of the rotor body 37 to the axle 36 preferably does not allow for a relative movement of the rotor body 37 and the axle 36 in the axial direction A. The rotor body 37 is for example fixed to the axle 36 by a shrink-fit.

Making the axle 36 of a ceramic material and the rotor body 37 of a metallic material has the advantage that the axle 36 can be manufactured such that the clearances to the stationary mating partners of the axle 36, e.g. the radial bearing flow passages 61 and the axial bearing flow passages 62, are very narrow. Thus, a stable hydrostatic support in combination with a very low leakage flow through the clearances results. On the other hand, the rotor body 37 made of a metallic material is easier to machine. For example, it might be less laborious to manufacture the channels 4 in the rotor body 37.

In addition, in FIG. 3 some more details of the hydrostatic support of the rotor 3 are schematically shown. For the sake of clarity, these details are not shown in FIG. 1. It has to be understood, that also the first embodiment shown in FIG. 1 can comprise these details. Furthermore, in FIG. 3 the details are only shown in the second end cover 6, which is the end cover 6 on the right side of FIG. 3. It goes without saying, that the details are also provided at the first end cover 5, but the details are not shown in FIG. 3 for the first end cover 5. Thus, the following explanations referring to the second end cover 6 and the bearing recess 56 disposed therein also apply in the same or an analogous manner to the first end cover 5.

The second end cover 6 includes a supply groove 63 and a discharge groove 64. Each of the supply groove 63 and the discharge groove 64 is configured as a annular groove disposed in the inner cylindrical surface of the bearing recess 56, i.e. in that surface, which faces the outer circumferential face of the hearing pin 35. Both the supply groove 63 and the discharge groove 64 extend along the entire circumference of the inner cylindrical surface of the bearing recess 56. The supply groove 63 and the discharge groove 64 are arranged parallel and axially displaced to each other. The radial bearing flow passage 61 provides a fluid communication between the supply groove 63 and the discharge groove 64.

A first supply passage 65 ends in the supply groove 63. The first supply passage 65 extends, for example, inside the second end cover 6 and is connected to a location, where the high pressure second fluid is available. For example, the first supply passage 65 can open out into a location adjacent to the second rotor end 32 and the second outlet port 26, where the high pressure second fluid leaves the housing 2. Thus, by the first supply passage 65 the supply groove 63 is in fluid communication with a location, where the high pressure of the second fluid prevails. Thus, the high pressure second fluid is supplied through the first supply passage 65 to the supply groove 63.

A discharge passage 66 ends in the discharge groove 64. The discharge passage 66 extends, for example, inside the second end cover 6 and is connected to a location, where the low pressure second fluid is available. For example, the discharge passage 66 can open out into a location adjacent to the second rotor end 32 and the second inlet port 25, where the low pressure second fluid enters the housing 2. Thus, by the discharge passage 66 the discharge groove 64 is in fluid communication with a location, where the low pressure of the second fluid prevails. Thus, the second fluid can be discharged from the discharge groove 64 through the discharge passage 66 to the second inlet port 25.

During operation the high pressure second fluid is supplied to the supply groove 63 through the first supply passage 65. Since the discharge groove 64 is in fluid communication with the second inlet port 25 by the discharge passage 66, a pressure drop exists along the bearing pin 35 in the axial direction A from the supply groove 63 to the discharge groove 64. This pressure drop causes the second fluid to flow from the supply groove 63 through the radial bearing flow passage 61 to the discharge groove 64 and therewith generating the hydrostatic radial support for the rotor 3.

For providing the hydrostatic axial support of the rotor 3 a second supply passage 67 ends in the axial bearing flow passage 62, which is arranged—regarding the axial direction A—between the bearing pin 35 and the bottom of the bearing recess 56. The second supply passage 67 extends, for example, inside the second end cover 6 and is connected to a location, where the high pressure second fluid is available. For example, the second supply passage 67 can open out into a location adjacent to the second rotor end 32 and the second outlet port 26, where the high pressure second fluid leaves the housing 2. Thus, by the second supply passage 67 the axial bearing flow passage 62 is in fluid communication with a location, where the high pressure of the second fluid prevails. Thus, the high pressure second fluid is supplied through the second supply passage 67 to the axial bearing flow passage 62. It is also possible that the second supply passage 67 ends in or is connected to the first supply passage 65.

During operation the high pressure second fluid is supplied to the axial bearing flow passage 62 through the second supply passage 67. Since the discharge groove 64 is in fluid communication with the second inlet port 25 by the discharge passage 66, a pressure drop exists along the bearing pin 35 from the axial bearing flow passage 62 to the discharge groove 64. This pressure drop causes the second fluid to flow from the second supply passage 67 through the axial bearing flow passage 62 to the discharge groove 64. This generates the hydrostatic axial support for the rotor 3, FIG. 4 shows a schematic cross-sectional view of a second embodiment of a rotary-pressure exchanger 1 according to the disclosure in a cut along the axial direction A.

In the following description of the second embodiment of a rotary pressure exchanger 1 only the differences to the first embodiment and its variant are explained in more detail. The explanations with respect to the first embodiment and its variant are also valid in the same way or in analogously the same way for the second embodiment. Same reference numerals designate the same features that have been explained with reference to the first embodiment and its variant or functionally equivalent features.

Figure 4:
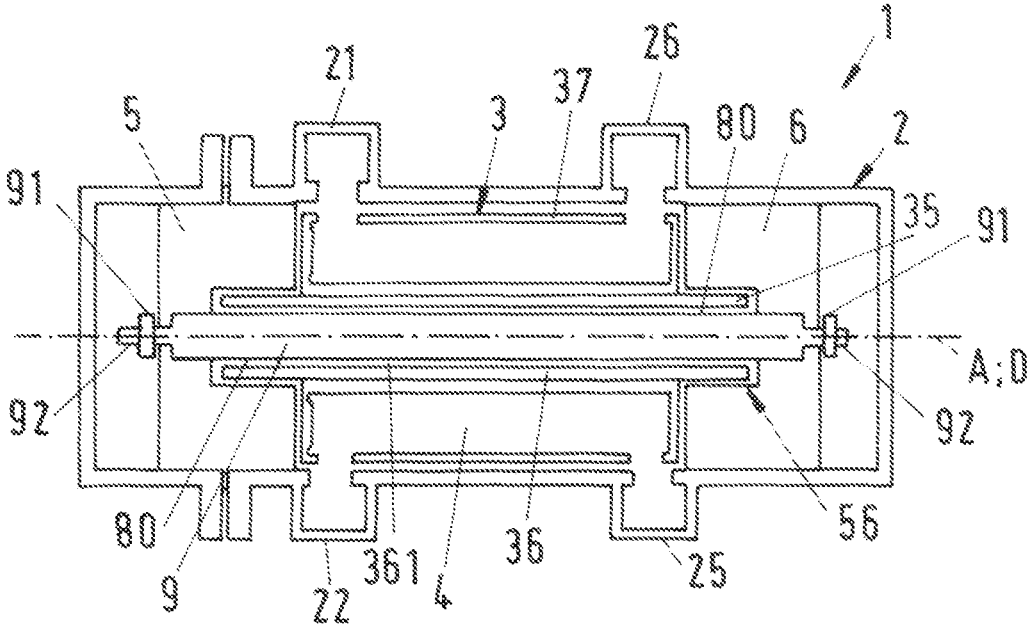
FIG. 4 illustrates a schematic cross-sectional view of a second embodiment of a rotary pressure exchanger according to the disclosure in a cut along the axial direction.

In FIG. 4 the details related to the hydrostatic support of the rotor 3 such as the supply groove 63 or the discharge groove 64 are not shown for the sake of clarity.

In the second embodiment of the rotary pressure exchanger 1 the axle 36 of the rotor 3 is configured as a hollow axle 36 comprising a central opening 361 extending completely through the axle 36 in the axial direction A. Each end cover 5, 6 comprises a central bore 80 aligned with the central opening 361. Each central bore 80 extends completely through the respective end cover 5, 6 in the axial direction A. A bolt 9 is disposed in the hollow axle 36. The bolt 9 extends in the axial direction A through both central bores 80 and through the central opening 361. The bolt 9 is secured to the first end cover 5 and to the second end cover 6, so that the bolt 9 is stationary, i.e. non-rotating, during operation. For fixing the bolt 9 to the end covers 5, 6 for example a nut 91 can be disposed at each end cover 5, 6, wherein the nut 91 engages with a threaded end portion 92 of the bolt 9. The bolt 9 functions as a tie rod which rigidly connects and fixes the first end cover 5 and the second end cover 6 to each other. The rotor 3 is firmly supported during rotation between the first end cover 5 and the second end cover 6. The bolt 9 can be made of a metallic material. The clearance in the central opening 361 between the bolt 9 and the radially inner wall delimiting the hollow axle 36 can be filled with the first fluid or with the second fluid to provide hydrostatic support to the rotor 3.

Figure 5:
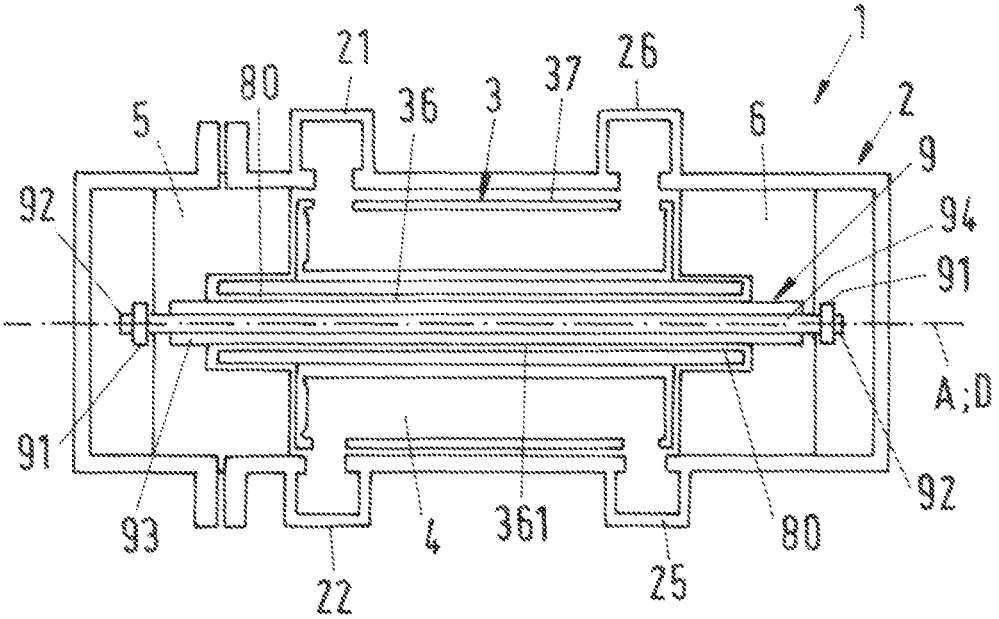
FIG. 5 illustrates a schematic cross-sectional view of a first variant of the second embodiment in a cut along the axial direction.

FIG. 5 shows a schematic cross-sectional view of a first variant of the second embodiment of the rotary pressure exchanger 1 in a cut along the axial direction A. In this first variant, the bolt 9 comprises a central core 94 extending in the axial direction A along the entire length of the bolt 9 and a sleeve 93 arranged coaxially with the core 94 and abutting against the core 94, wherein the sleeve 93 is made of a first material, preferably a ceramic material. The central core 94 is made of a second material, preferably a metallic material, wherein the first material is different from the second material. With respect to the axial direction A the sleeve 93 extends from the central bore 80 in the first end cover 5 to the central bore 80 in the second end cover 6, such that the threaded end portions 92 are not surrounded by the sleeve 93. The stationary sleeve 93 serves for aligning the end covers 5, 6 with the rotor 3 and for supporting the rotor 3 by a hydrostatic bearing between the sleeve 93 and the radially inner wall delimiting the central opening 361 of the hollow axle 36. The sleeve 93 is preferably made of a ceramic material to allow for a high dimensional precision regarding the alignment of the components as well as for a very narrow clearance between the sleeve 93 and the radially inner wall of the axle 36 delimiting the central opening 361.

Figure 6:
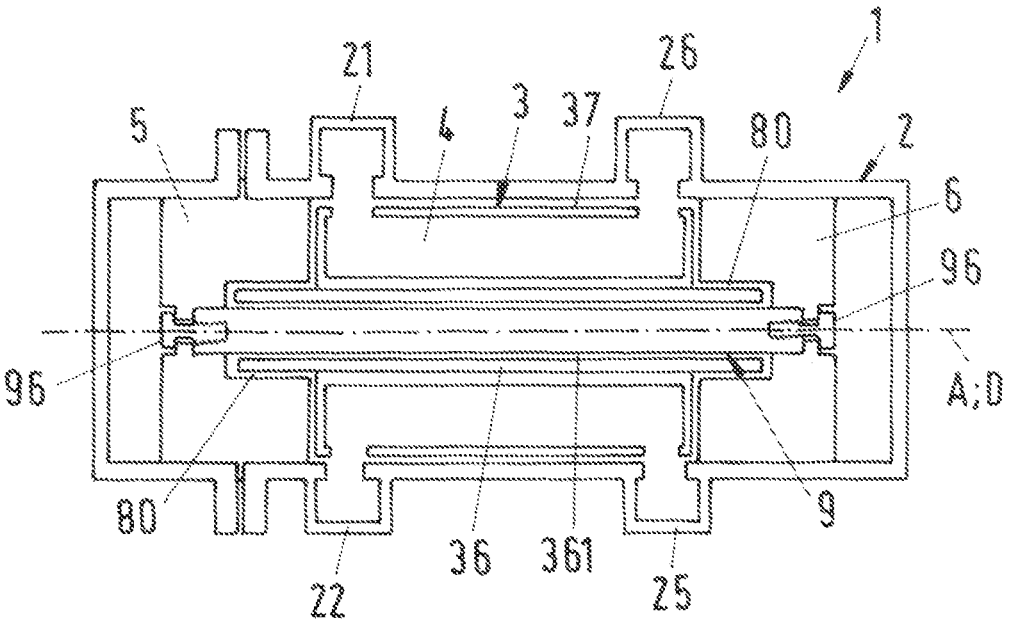
FIG. 6 illustrates a schematic cross-sectional view of a second variant of the second embodiment in a cut along the axial direction.

FIG. 6 shows a schematic cross-sectional view of a second variant of the second embodiment of the rotary pressure exchanger in a cut along the axial direction A. In the second variant the bolt 9 is configured as a cylindrical solid pole extending from the central bore 80 in the first end cover 5 in axial direction A to the central bore 80 in the second end cover 6. The bolt 9 is fixed to the first end cover 5 by a fixing element 96 engaging with one of the axial ends of the bolt 9, The bolt 9 is fixed to the second end cover 6 by a fixing element 96 engaging with the other axial ends of the bolt 9. The fixing elements 96 can be configured for example as screws, wherein each screw engages with a thread disposed in the respective axial end of the bolt 9, In the second variant the bolt 9 is preferably made of a metallic material. Of course, the bolt 9 can also be made of a ceramic material, in particular, if a high precision is required or desired.

Figure 7:
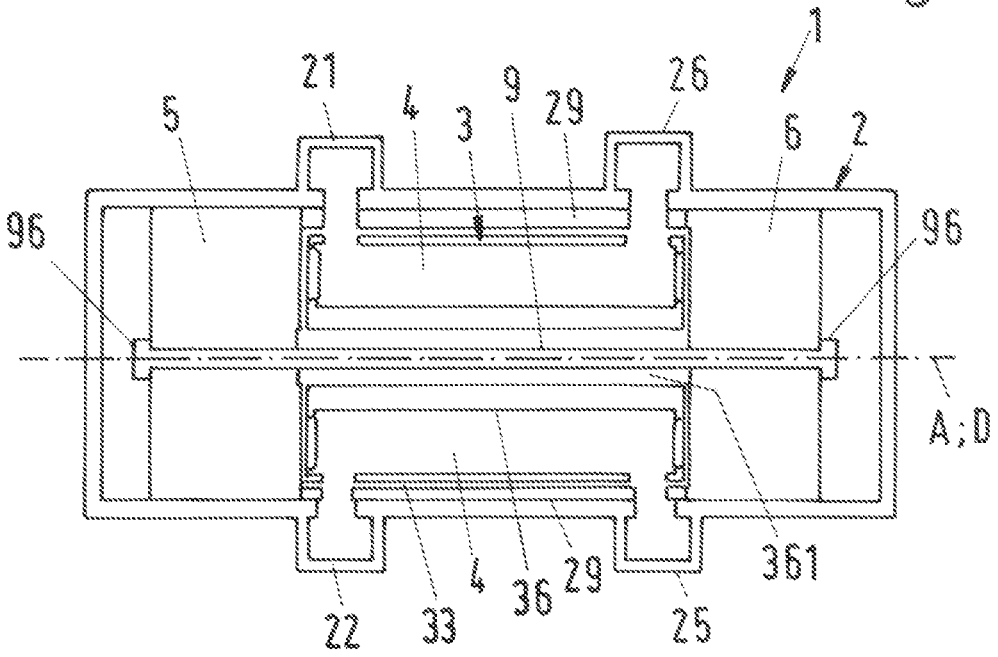
FIG. 7 illustrates a schematic cross-sectional view of a third embodiment of a rotary pressure exchanger according to the disclosure in a cut along the axial direction.

FIG. 7 shows a schematic cross-sectional view of a third embodiment of a rotary pressure exchanger 1 according to the disclosure in a cut along the axial direction A.

In the following description of the third embodiment of a rotary pressure exchanger 1 only the differences to the first and the second embodiment and their variants are explained in more detail. The explanations with respect to the first and the second embodiment as well as their variants are also valid in the same way or in analogously the same way for the third embodiment. Same reference numerals designate the same features that have been explained with reference to the first and the second embodiment and their variants or functionally equivalent features.

In the third embodiment of the rotary pressure exchanger 1 a sleeve positioning concept is used for supporting the rotor. The third embodiment does not include the bearing pins 35 and the bearing recesses 56 in the end covers 5, 6. The rotor 3 has an overall shape of a cylinder.

In the third embodiment the rotor 3 is surrounded by a stationary rotor sleeve 29. Regarding the axial direction A, the rotor sleeve 29 extends from the first end cover 5 to the second end cover 6, with the rotor sleeve 29 arranged stationary with respect to the housing 2. The rotor 3 is arranged within the rotor sleeve 29, so that the rotor sleeve 29 surrounds the circumferential surface 33 of the rotor 3. The rotor 3 and the rotor sleeve 29 arranged coaxially with the rotor 3 are configured such that there is only a narrow clearance between the circumferential surface 33 of the rotor 3 and the rotor sleeve 29. During operation of the device the narrow gap between the rotor and the sleeve provides a hydrodynamic and/or hydrostatic support of the rotor 3.

The rotor sleeve 29 is clamped between the first end cover 5 and the second end cover 6, The axle 36 of the rotor 3 is configured as a hollow axle having the central opening 361, through which the bolt 9 extends. The hollow axle 36 constitutes an internal part of the rotor 3 being stationary with respect to the rotor 3. The bolt 9 is fixed to the first end cover 5 as well as to the second end cover 6 by the fixing elements 96, which are configured for example as nuts or screws. By the bolt 9 and the fixing elements 96 the end covers 5, 6 are rigidly and firmly secured to each other with the rotor sleeve 29 clamped therebetween. Preferably, the central opening 361 is connected to a source for a high pressure fluid, e.g. the high pressure first fluid or the high pressure second fluid by a fluid passage (not shown). Furthermore, a drainage passage can be provided to discharge fluid (not shown) from the central opening 361.

Figure 8:
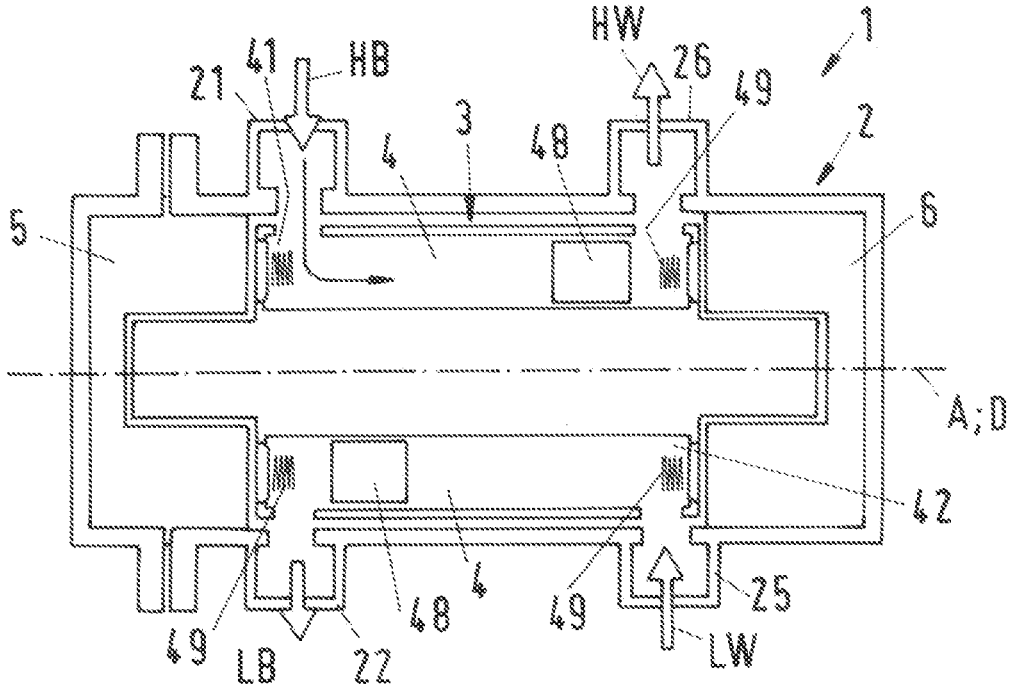
FIG. 8 and FIG. 9, are as FIG. 1, however with some optional features applicable to all embodiments.
Figure 9:
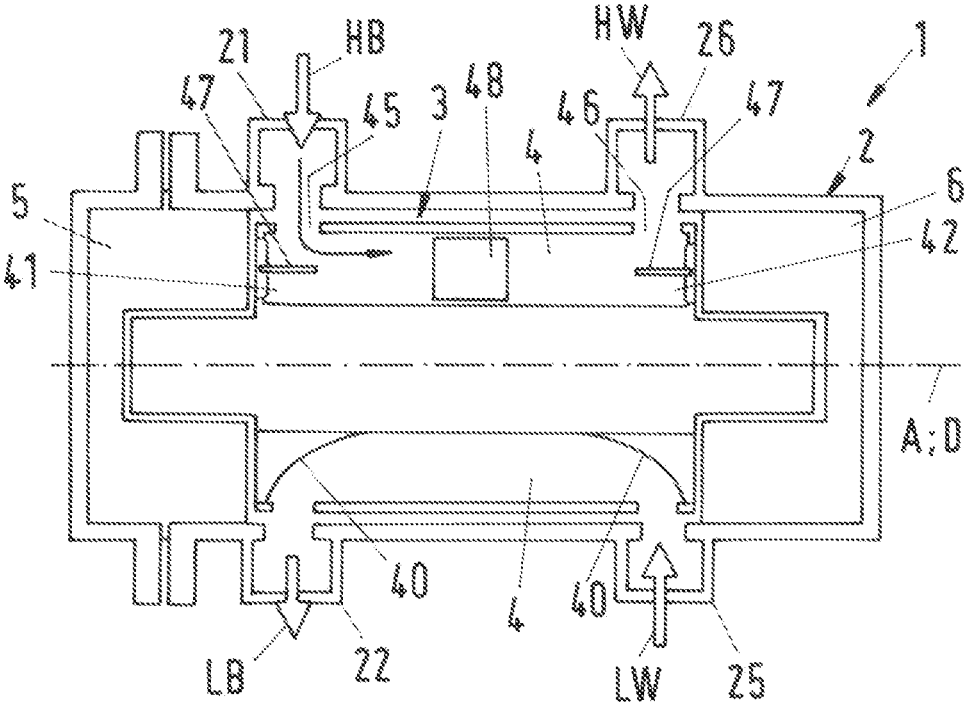

FIG. 8 and FIG. 9 illustrate some optional features, which are applicable to all embodiments and their variants. As it can be seen in FIG. 8 it is possible to disposed in each of the channels 4 a freely sliding separator 48 for at least reducing the mixing between the first fluid and the second fluid within the channels 4. The separator 48 works comparable to a hydraulic piston and transfers pressure between the two fluids. Each separator can be configured as a free floating piston or as a ball. Optionally, each of the first axial ends 41 and each of the second axial ends 42 of the channels can include a spring 49 to dampen the movement of the separators 48 at the first axial ends 41 and at the second axial ends 42.

As it is shown in the upper part of FIG. 9 it is also possible to replace the springs 49 with distance pins 47 disposed at the first axial ends 41 and/or at the second axial ends 42 of the channels 4. The distance pins 47 extend into the channels 4 to prevent a blocking of the first openings 45 and/or the second openings 46 by the separators 48.

The lower part of FIG. 9 illustrates a further optional feature, namely to provide flow guiders 40 in the channels 4 at the first axial ends 41 of the channels 4 and/or at the second axial ends 42 of the channels 4. The flow guiders are configured to smoothly redirect the fluids from the radial direction to the axial direction A when entering the channels 4 and/or from the axial direction A to the radial direction for leaving the channels 4.

FIG. 10 to FIG. 13 illustrate several options regarding the channels 4 of the rotor 3 and in particular regarding the closing of the channels 4 at the first axial end 41 and at the second radial end 42. Since it is sufficient for the understanding in each of FIG. 10-FIG. 13 only one of the channels 4 of the rotor 3 is shown.

Figure 10:
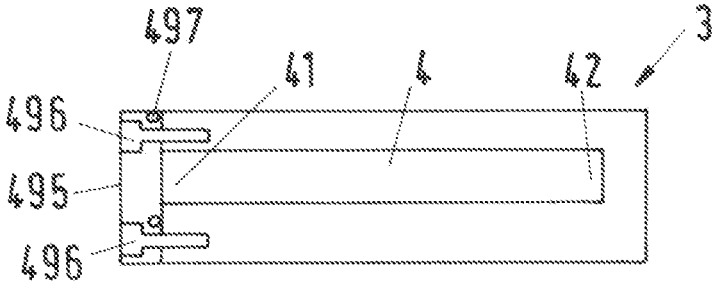
FIGS. 10-13 illustrate in each case one of the channels in the rotor in a schematic cross-sectional view in a cut along the axial direction.
Figure 11:
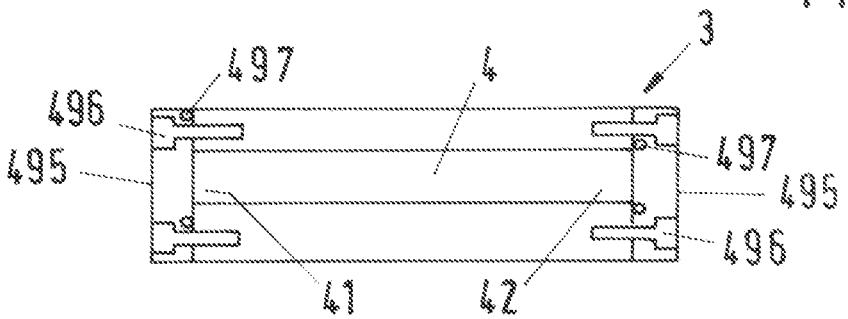

In FIG. 10 and in FIG. 11 the first opening 45 and the second opening 46 of the channel 4 are not visible because they are located in front of the cutting plane.

In the configuration shown in FIG. 10 each channel 4 is manufactured by machining a longitudinal blind bore into the body of the rotor 3. After the longitudinal blind bore has been finished the first opening 45 and the second opening 46 are provided by drilling a radially extending bore from the circumferential surface 33 of the rotor 3 to the longitudinal bore. The open end of the longitudinal blind bore, here at the first axial end 41, is closed by a closing element 495, which is fixed to the rotor 3 by screws 496 or other suitable fixing means or elements. A sealing element 497 such as an O-ring can be arranged between the closing element 495 and the first end 41 of the channel 4. The closing element 495 can be configured fir closing a plurality of first ends 41 of different channels 4, for example by configuring the closing element 495 as a ring-shaped closing element 495.

In the configuration shown in FIG. 11 each channel 4 is manufactured by machining a longitudinal bore into the rotor 3, wherein the longitudinal bore extends completely throughout the rotor 3. After that, both the first axial end 41 and the second axial end 42 are closed with a respective closing element 495.

Figure 12:
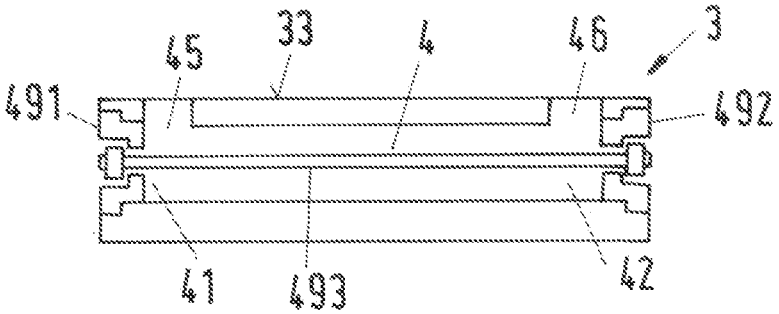

In the configuration shown in FIG. 12, the first axial end 41 of the channel 4 is closed with the first plug 491 and the second axial end 42 of the channel 4 is closed by the second plug 492. The first plug 491 and the second plug 492 are firmly secured to each other by a tie-rod 493 longitudinally extending through the channel 4.

Figure 13:
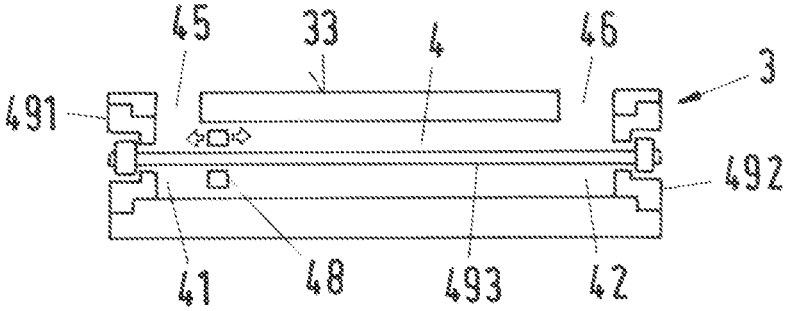

In the configuration shown in FIG. 13, the freely sliding separator 48 is disposed in the channel 4, wherein the separator 48 is arranged on the tie-rod 493 for slidingly moving forth and back in the axial direction A.

What is claimed is:

1. A rotary pressure exchanger for transferring pressure from a first fluid to a second fluid, comprising:

a housing; and a rotor mounted within the housing, and configured to rotate about an axis of rotation defining an axial direction;

a plurality of channels disposed inside the rotor, and configured to transfer pressure from the first fluid to the second fluid, each channel of the plurality of channels extends parallel to the axis of rotation, the housing comprising a first inlet port configured to supply the first fluid to the plurality of channels in the rotor, a first outlet port configured to discharge the first fluid from the plurality of channels in the rotor, a second inlet port configured to supply the second fluid to the channels in the rotor, and a second outlet port configured to discharge the second fluid from the plurality of channels in the rotor, each channel of the plurality of channels extends from a first axial end to a second axial end so as to form an opening in at least one surface of the first or second axial end, at least one of the first axial end and the second axial end of each channel of the plurality of channels includes a closing element, the closing element for each channel of the plurality of channels attached to the at least one of the first axial end and the second axial end to close the opening in the at least one surface of the first or second axial end, and the first inlet port and the second inlet port being radial inlet ports, such that the first fluid and the second fluid are capable of entering the rotor in a radial direction perpendicular to the axial direction, and the first outlet port and the second outlet port being radial outlet ports, such that the first fluid and the second fluid are capable of leaving the rotor in the radial direction.

2. The rotary pressure exchanger in accordance with claim 1, wherein the rotor extends from a first rotor end in the axial direction to a second rotor end, the rotor comprises a circumferential surface delimiting the rotor with respect to the radial direction, each channel comprises a first opening and a second opening for the fluids, and each first opening and each second opening are arranged in the circumferential surface of the rotor.

3. The rotary pressure exchanger in accordance with claim 1, further comprising a plurality of bearing flow passages configured to hydrostatically support of the rotor.

4. The rotary pressure exchanger in accordance with claim 2, further comprising a first end cover and a second end cover, with each of the first end cover and the second end cover being arranged stationary with respect to the housing, and the rotor is arranged between the first end cover and the second end cover regarding the axial direction.

5. The rotary pressure exchanger in accordance with claim 4, wherein each of the first end cover and the second end cover is a ceramic material.

6. The rotary pressure exchanger in accordance with claim 4, wherein each of the first rotor end and the second rotor end comprises a bearing pin extending in the axial direction and configured coaxially with the axis of rotation, each of the first end cover and the second end cover comprises a bearing recess configured to receive one of the bearing pins, and each bearing pin engages with one of the bearing recesses.

7. The rotary pressure exchanger in accordance with claim 6, wherein at each of the first rotor end and the second rotor end, a radial bearing flow passage and an axial bearing flow passage are disposed between the bearing recess and the bearing pin engaging the bearing recess, each radial bearing flow passage is configured to provide hydrostatic radial support of the rotor, and each axial bearing flow passage is configured to provide hydrostatic axial support of the rotor.

8. The rotary pressure exchanger in accordance with claim 6, wherein the rotor comprises an axle and a rotor body, the axle comprises both bearing pins and extends from the bearing pin at the first rotor end to the bearing pin at the second rotor end, the rotor body comprises all of the plurality of channels, and the rotor body is fixedly connected to the axle in a torque proof manner.

9. The rotary pressure exchanger in accordance with claim 8, wherein the axle is a first material, the rotor body is a second material, and the first material is different from the second material.

10. The rotary pressure exchanger in accordance with claim 8, wherein the axle is a hollow axle comprising a central opening extending completely through the axle in the axial direction, each of the first end cover and the second end cover comprises a central bore aligned with the central opening, with each central bore the first end cover and the second end cover extending completely through a respective end cover in the axial direction, a bolt extends in the axial direction through each central bore the first end cover and the second end cover and through the central opening, and the bolt is secured to each of the first end cover and the second end cover.

11. The rotary pressure exchanger in accordance with claim 10, wherein the bolt comprises a central core extending in the axial direction along an entire length of the bolt, and a sleeve arranged coaxially with the core and abutting against the core, the sleeve is a first material, the central core is a second material, and the first material is different from the second material.

12. The rotary pressure exchanger in accordance with claim 4, further comprising a rotor sleeve extending regarding the axial direction from the first end cover to the second end cover, with the rotor sleeve arranged stationary with respect to the housing, the rotor is arranged within the rotor sleeve, so that the rotor sleeve surrounds the circumferential surface of the rotor.

13. The rotary pressure exchanger in accordance with claim 1, wherein each first axial end includes a first plug to close the first axial end, and each second axial end includes a second plug to close closing the second axial end.

14. The rotary pressure exchanger in accordance with claim 1, wherein in each channel of the plurality of channels a freely sliding separator is provided to reduce a mixing of the first fluid and the second fluid.

15. The rotary pressure exchanger in accordance with claim 9, wherein the first material is a ceramic material and the second material is a metallic material.

16. The rotary pressure exchanger in accordance with claim 11, wherein the first material is a ceramic material and the second material is a metallic material.

17. The rotary pressure exchanger in accordance with claim 1, wherein for each channel of the plurality of channels, the closing element is configured to seal the channel.

18. The rotary pressure exchanger in accordance with claim 1, wherein for each channel of the plurality of channels, a sealing element is disposed between the closing element and the at least one of the first axial end and the second axial end of each channel of the plurality of channels.

* * * * *